US005913714A

United States Patent [19]

Volodarsky et al.

[11] Patent Number: 5,913,714

[45] Date of Patent: Jun. 22, 1999

[54] METHOD FOR DRESSING A POLISHING PAD DURING POLISHING OF A SEMICONDUCTOR WAFER

[75] Inventors: Konstantin Volodarsky, San Francisco; Rahul Jairath, San Jose, both of Calif.

[73] Assignee: Ontrak Systems, Inc., Fremont, Calif.

[21] Appl. No.: 09/153,817

[22] Filed: Sep. 15, 1998

Related U.S. Application Data

[62] Division of application No. 08/826,552, Apr. 4, 1997, Pat. No. 5,857,899.

[51] Int. Cl.[6] ..... B24B 1/00

[52] U.S. Cl. ..... 451/41; 451/56; 451/72

[58] Field of Search ..... 451/41, 56, 72, 451/443

[56] References Cited

U.S. PATENT DOCUMENTS

| | | |
|---|---|---|
| 3,579,916 | 5/1971 | Boettcher . |
| 3,731,435 | 5/1973 | Boettcher et al. . |
| 4,519,168 | 5/1985 | Cesna . |
| 5,205,082 | 4/1993 | Shendon et al. . |
| 5,329,732 | 7/1994 | Karlsrud et al. . |
| 5,329,734 | 7/1994 | Yu . |
| 5,377,451 | 1/1995 | Leoni et al. . |
| 5,398,459 | 3/1995 | Okumura et al. . |
| 5,423,558 | 6/1995 | Koeth et al. . |
| 5,423,716 | 6/1995 | Strasbaugh . |
| 5,441,444 | 8/1995 | Nakajima . |
| 5,449,316 | 9/1995 | Strasbaugh . |
| 5,456,627 | 10/1995 | Jackson et al. . |
| 5,476,414 | 12/1995 | Hirose et al. . |
| 5,527,209 | 6/1996 | Volodarsky et al. . |
| 5,547,417 | 8/1996 | Breivogel et al. . |
| 5,584,751 | 12/1996 | Kobayashi et al. . |
| 5,605,499 | 2/1997 | Sugiyama et al. . |
| 5,643,067 | 7/1997 | Katsuoka et al. . |
| 5,653,623 | 8/1997 | Kimura et al. . |

FOREIGN PATENT DOCUMENTS

| | | |
|---|---|---|
| 0 747 167 A2 | 12/1996 | European Pat. Off. . |
| 0 768 148 A1 | 4/1997 | European Pat. Off. . |
| 55-157473 | 12/1980 | Japan . |
| 59-187456 | 10/1984 | Japan . |
| 6-91522 | 4/1994 | Japan . |

OTHER PUBLICATIONS

E. Worthington, "New CMP Architecture Addresses Key Process Issues", Solid State Technology, Jan. 1996, pp. 61–62.

*Primary Examiner*—Timothy V. Eley
*Attorney, Agent, or Firm*—Brinks Hofer Gilson & Lione

[57] ABSTRACT

A polishing pad dressing method uses a polishing head for polishing a semiconductor wafer. This polishing head includes a housing, a wafer carrier movably mounted to the housing, and a pad dressing element movably mounted to the housing. The wafer carrier forms a wafer-supporting surface, and the dressing element surrounds the wafer-supporting surface. A first fluid actuator is coupled to the dressing element to bias the pad dressing element with respect to the housing, and a second fluid actuator is coupled to the wafer carrier to bias the wafer carrier with respect to the housing. First and second fluid conduits are coupled to the first and second actuators, respectively, such that fluid pressures in the first and second actuators are separately and independently adjustable with respect to one another. Biasing forces on the dressing element can thereby be dynamically adjusted with respect to biasing forces on the carrier during a polishing operation.

1 Claim, 2 Drawing Sheets

METHOD FOR DRESSING A POLISHING PAD DURING POLISHING OF A SEMICONDUCTOR WAFER

CROSS REFERENCE TO RELATED APPLICATION

This application is a division of U.S. patent application Ser. No. 08/826,552, now U.S. Pat. No. 5,857,889 filed Apr. 4, 1997. This prior-filed application is hereby incorporated by reference in its entirety.

BACKGROUND OF THE INVENTION

This invention relates to a polishing pad dressing method for use with a semiconductor wafer polishing machine.

Semiconductor wafer polishing machines are well known in the art, and are conventionally used to polish and planarize semiconductor wafers, which may include one or more photolithographic layers. Such polishing machines typically include one or more polishing heads, each of which supports a respective semiconductor wafer and positions the wafer adjacent a polishing pad. The polishing head is moved relative to the polishing pad, and a suitable polishing slurry is introduced between the wafer and the pad. U.S. patent application Ser. No. 08/287,658, filed Aug. 9, 1994, and assigned to the assignee of the present invention, discloses one such polishing machine that utilizes a belt-type polishing pad. Other polishing machines use rotary polishing pads, and are disclosed for example in U.S. Pat. Nos. 5,329,732 and 5,329,734.

Typically, a polishing head includes a central wafer carrier that is surrounded by a wafer retainer. The wafer carrier and the retainer cooperate to form a wafer-receiving pocket that prevents the wafer from moving laterally with respect to the polishing head during the polishing operation. It has been proposed to mount both the wafer carrier and the wafer retainer for relative movement with respect to the remainder of the polishing head and to bias the carrier and the retainer outwardly, toward the polishing pad. When this is done, both the retainer and the carrier are allowed to float to a limited extent with respect to the polishing head during the polishing operation.

Conventional wafer polishing operations typically include means for dressing the polishing pad, as for example by biasing a roughened element such as a ceramic element or a diamond-coated element into contact with the polishing pad in order to provide a consistent and effective polishing surface to the pad. One approach of the prior art is to apply the pad dressing element to the pad intermittently, between wafer polishing operations. This approach slows the throughput of a wafer polishing machine excessively. Another approach of the prior art is to devote one of the polishing heads of a multi-head polishing machine to pad dressing. With this approach a pad dressing element is mounted to a polishing head in substitution for a semiconductor wafer. While this approach allows pad dressing to be carried on during the wafer polishing operation, it also reduces throughput of the wafer polishing machine. This is because one of the wafer polishing heads is used for pad dressing, and not for wafer polishing.

It would be highly advantageous if it were possible to accomplish required pad dressing activities while increasing throughput of a wafer polishing machine.

SUMMARY OF THE INVENTION

According to this invention, a method is provided for dressing a polishing pad during polishing of a semiconductor wafer. This method includes the initial step of mounting a semiconductor wafer on a wafer carrier of a polishing head, wherein the polishing head comprises a pad dressing element movably mounted to the polishing head radially outwardly of the wafer-supporting surface. The wafer is polished by biasing the wafer against a polishing pad with a wafer biasing force while moving the polishing pad across the wafer, and the pad dressing element is biased against the polishing pad with a dressing element biasing force. The method includes the step of adjusting the dressing element biasing force with respect to the wafer biasing force during the polishing step.

Because the pad dressing element is positioned radially outwardly from the wafer, pad dressing operations can be performed at the same time as polishing operations, without reducing the throughput of the wafer polishing machine. Pad dressing activities can be modified during the wafer polishing operation by adjusting the pad dressing element biasing force. In this way, pad dressing can be performed intermittently during the polishing operation or with varying degrees of force, as desired. In some cases, it may be preferable to interrupt pad dressing activities by lifting the pad dressing element out of contact with the polishing pad during the polishing operation.

As used herein, wafer polishing is intended broadly to encompass both polishing operations of a semiconductor wafer before additional layers have been deposited onto the wafer, as well as wafer planarization operations performed on layer carrying wafers.

BRIEF DESCRIPTION OF THE DRAWINGS

In FIG. 1, the polishing head is shown in a polishing position, in which both the semiconductor wafer and the pad dressing element are in contact with a polishing pad.

DETAILED DESCRIPTION OF THE PRESENTLY PREFERRED EMBODIMENT

Figure 1:
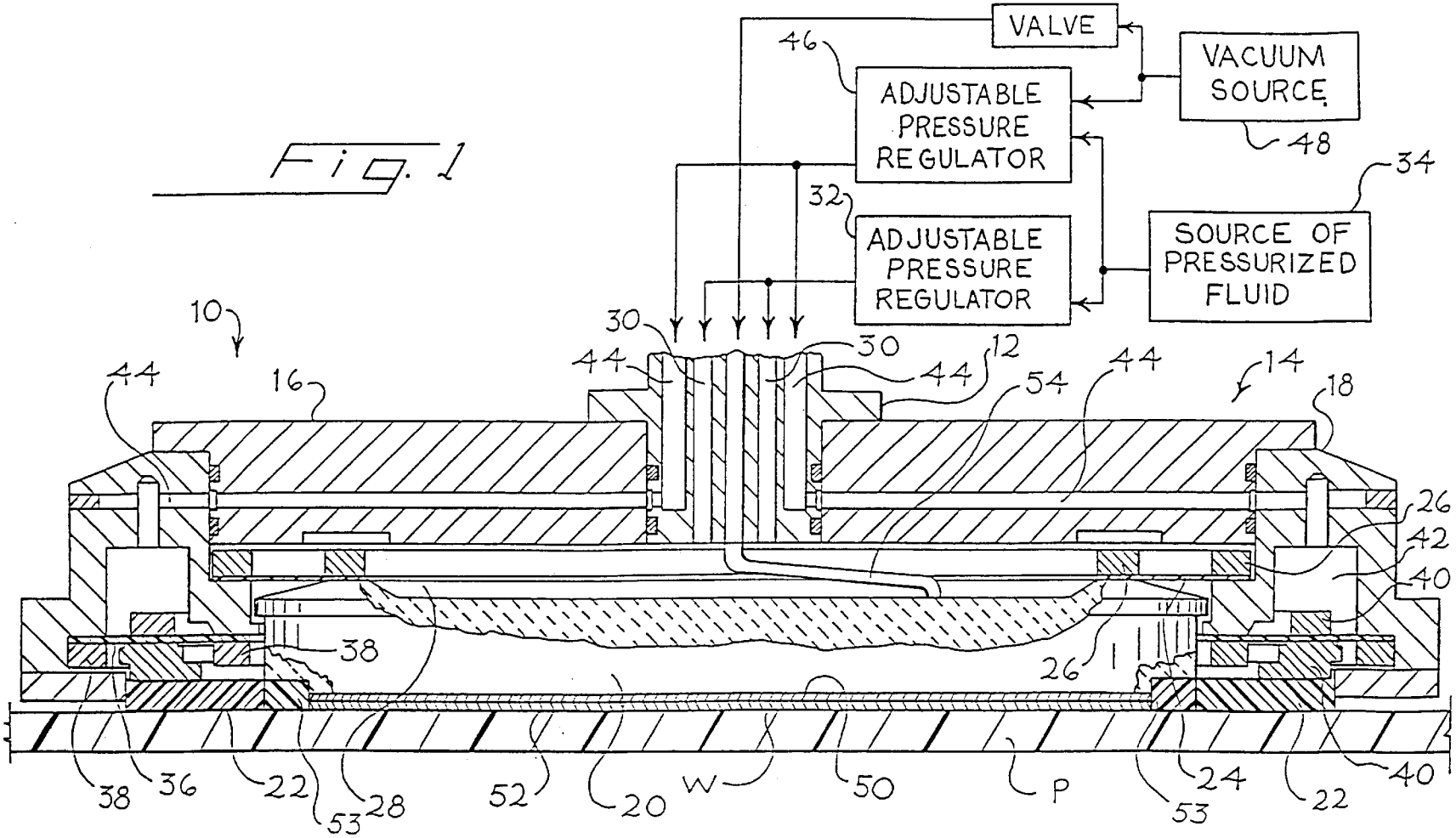
FIG. 1 is a cross-sectional view of a polishing head that incorporates a preferred embodiment of this invention.

Turning now to the drawings, FIG. 1 shows a cross-sectional view of a polishing head 10 that incorporates a presently preferred embodiment of this invention. This polishing head 10 can be mounted to any suitable semiconductor wafer polishing machine, including any of the polishing machines discussed above, as well as others known now or in the future to those skilled in the art. The polishing head 10 includes a spindle 12 that is rigidly secured to a housing 14. The housing 14 is made up of an inner housing 16 and an outer housing 18. The inner housing 16 is rigidly secured to the spindle 12, as for example by bolts (not shown), and the outer housing 18 is rigidly secured to the inner housing 16, as for example by bolts (not shown). The housings 14,18 can be formed of aluminum or stainless steel.

The polishing head 10 also includes a wafer carrier 20 and a pad dressing element 22. The pad dressing element 22 is annular in shape, and movably mounted to the housing 14 by an annular first diaphragm 36, that can be formed of a resilient material such as BUNA material. The element 22 can be made of any suitable material. For example, the element 22 may be formed of 316 stainless steel coated with CVD diamond (e.g. 100 grit), or a suitable ceramic formed with sharp points. The element 22 may be formed in separate parts that extend partially around the wafer carrier 20, or alternately may be formed as an annulus that extends completely around the wafer carrier 20. The inner and outer marginal edges of the first diaphragm are secured to the outer housing 18 by mounting rings 38, and the central portion of the first diaphragm is secured to the element 22 by mounting rings 40. The first diaphragm 36 and the housing 14 cooperate to form a first fluid chamber 42 that is bounded in part by the first diaphragm 36. This first fluid chamber 42 is connected by a first fluid conduit 44 to a first adjustable pressure regulator 46. The first adjustable pressure regulator 46 is connected both to a source of pressurized fluid 34 and to a vacuum source 48.

The wafer carrier 20 is circular in shape and is movably mounted with respect to the housing 14 by a second annular diaphragm 24. The carrier can be formed of a ceramic such as alumina 995. The second diaphragm 24 can be formed of a resilient material such as BUNA material and is mechanically secured at its radially inner edge to the wafer carrier 20 and at its radially outer edge to the outer housing 18 by mounting rings 26. The housing 14, the wafer carrier 20 and the second diaphragm 24 cooperate to form a second fluid chamber 28 that is connected by a second fluid conduit 30 to a second adjustable pressure regulator 32. The second adjustable pressure regulator 32 is in turn connected to the source of pressurized fluid 34.

The first diaphragm 36, the first fluid chamber 42 and the first fluid conduit 44 cooperate to form a first fluid actuator which can be used to adjust a biasing force tending to urge the dressing element 22 outwardly, toward the polishing pad P. The first fluid actuator is annular in shape and thereby applies evenly distributed biasing forces to the dressing element 22. The first diaphragm 36 performs two separate functions: movably mounting the element 22 with respect to the housing 14, and sealing the first fluid chamber 42.

The wafer carrier defines a wafer-supporting surface 50 that in the conventional manner supports an insert 52 and a wafer retainer 53. A vacuum conduit 54 is conducted between the vacuum source 48 and the wafer carrier 20. The vacuum source 48 can be used to create a low pressure suction tending to hold a wafer W in place on the insert 52. When the wafer W is positioned on the insert 52, the wafer retainer 53 substantially surrounds the wafer W to prevent undesired lateral movement between the wafer W and the polishing head 10.

The second fluid chamber 28, the second fluid conduit 30 and the second diaphragm 24 cooperate with the wafer carrier 20 to form a second fluid actuator. The second adjustable pressure regulator 32 can be used to adjust the pressure of a fluid such as air in the second fluid chamber 28 in order to provide a dynamically adjustable biasing force tending to press the wafer W against the polishing pad P of the polishing machine. This second fluid actuator provides an evenly distributed force across substantially the entire upper surface of the wafer carrier 20, thereby minimizing uneven forces that might tend to distort the wafer carrier 20. The second diaphragm 24 performs both a mounting function in that it allows differential movement between the carrier 20 and the housing 14, and a sealing function in that it seals pressurized fluid in the second fluid chamber 28.

Because the first fluid chamber 42, the first fluid conduit 44 and the first adjustable pressure regulator 46 are isolated from and independent of the second fluid chamber 28, the second fluid conduit 30 and the second adjustable pressure regulator 32, the biasing forces on the dressing element 22 can be adjusted in a dynamic fashion during the wafer polishing operation with respect to the biasing forces on the wafer carrier 20. In this way, pad conditioning and dressing forces applied by the dressing element 22 to the polishing pad P and the flow of polishing slurry onto the marginal edges of the wafer W can be adjusted in real time during the polishing operation.

The first and second adjustable pressure regulators 46, 32 operate as independently controllable valves. Of course, the widest variety of approaches can be used for the regulators 32, 46, including both manually controlled and computer controlled regulators. Other suitable means for adjusting fluid pressure may be substituted.

FIG. 1 shows the polishing head 10 in a use position, in which both the wafer W and the pad dressing element 22 are biased away from the housing 14, into contact with the polishing pad P. Note that in the polishing position both the wafer carrier 20 and the dressing element 22 are free to float over a limited range of movement, suspended by the respective diaphragms 24, 36.

Figure 2:
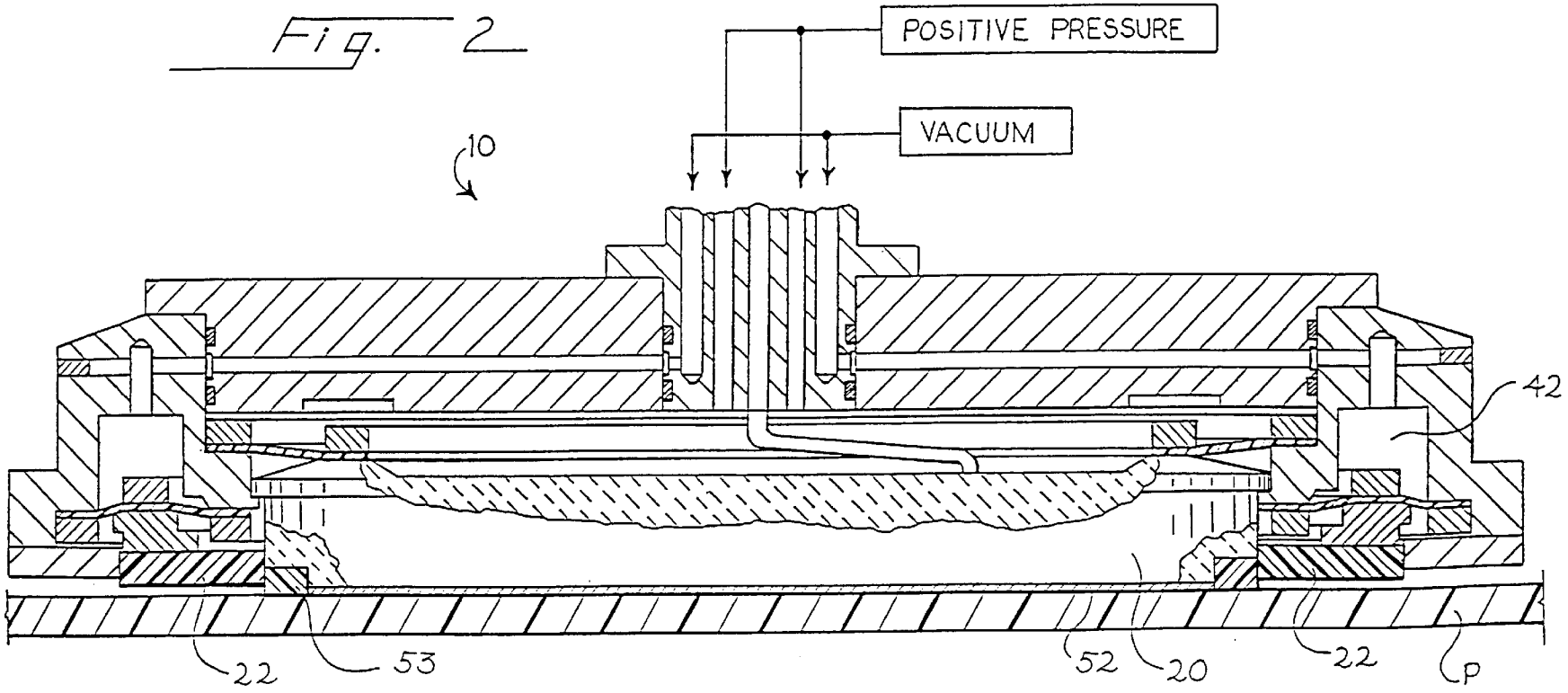
FIG. 2 is a cross-sectional view of the polishing head of FIG. 1 showing the wafer carrier and the wafer retainer in a polishing position, in which the pad dressing element is out of contact with the polishing pad.

FIG. 2 also shows the polishing head 10 in a use position. In this position, the wafer carrier 20 is biased into contact with the polishing pad P, as in FIG. 1. However, the first adjustable pressure regulator 46 (FIG. 1) has been used to apply a vacuum to the first fluid chamber 42 to move the dressing element 22 toward the housing 14, out of contact with the pad P.

The polishing head 10 can be used in a wafer polishing operation by first mounting the wafer W on the wafer carrier 20. The wafer can either be a bare substrate (without photolithographic layers) or a substrate bearing one or more photolithographic layers. The polishing head 10 is then brought adjacent to the polishing pad P and relative movement is provided between the polishing head 10 and the polishing pad P. This relative movement can be any desired combination of one or more of linear and rotary motions. The adjustable pressure regulators 32, 46 are then used to bias the wafer carrier and therefore the wafer W against the polishing pad P and the dressing element 22 against the polishing pad P. By independently adjusting the regulators 32, 46, the relative biasing force on the dressing element 22 can be varied (either increased or decreased) with respect to the biasing force on the wafer carrier 20. In this way, the degree to which the polishing pad P is compressed and dressed before it contacts the wafer W can be adjusted, as can the rate at which polishing slurry is admitted to the marginal edge of the wafer W.

The first and second fluid actuators described above operate as a means for creating a dynamically adjustable differential biasing force between the carrier 20 and the dressing element 22. It should be recognized that other means can be used for dynamically adjusting the differential biasing force between these two elements. For example, the entire polishing head 10 can be biased toward the polishing pad P, and the dressing element 22 can be movably mounted with respect the polishing head 10 and independently biased toward the pad P. When this approach is used, the carrier 20 can be rigidly mounted with respect to the housing 14.

Additionally, other sealing approaches can be used in substitution for the diaphragms 24, 36. For example, a single diaphragm can be provided which supports both the carrier 20 and the dressing element 22. Alternately, bellows or pistons with sliding seals can be substituted for the diaphragms disclosed above. The diaphragms shown in the drawings are preferred, because they minimize friction between the moving elements and the housing, while providing an excellent seal.

Additionally, this invention can be implemented with other types of actuators. Fluid actuators using a pressurized liquid can be substituted for the fluid actuators discussed above, which preferably use pressurized gas such as air. Furthermore, in some embodiments the fluid actuators can be replaced with actuators such as mechanical springs having a means for adjusting the spring force provided by the mechanical spring.

Finally, as pointed out above, the polishing head of this invention can be adapted for use with a wide variety of semiconductor wafer polishing machines, including machines with polishing pads having both linear and rotary movements.

It is therefore intended that the foregoing detailed description be regarded as illustrative rather than limiting. It is the claims, including all equivalents, which are intended to define the scope of this invention.

We claim:

1. A method for dressing a polishing pad during polishing of a semiconductor wafer, said method comprising the following steps:

a) mounting a semiconductor wafer on a wafer carrier of a polishing head, said polishing head comprising a pad dressing element movably mounted to the polishing head radially outwardly of a wafer-supporting surface;

b) polishing the wafer by biasing the wafer against the polishing pad with a wafer biasing force while moving the polishing pad across the wafer;

c) biasing the pad dressing element against the polishing pad with a dressing element biasing force; and d) adjusting the dressing element biasing force with respect to the wafer biasing force during the polishing step (b).

* * * * *